US009521939B2

(12) United States Patent
Haarburger

(10) Patent No.: US 9,521,939 B2
(45) Date of Patent: Dec. 20, 2016

(54) SYSTEMS AND METHODS FOR A SCREEN CLEANER

(71) Applicant: Nite Ize, Inc., Boulder, CO (US)

(72) Inventor: Daniel J. Haarburger, Boulder, CO (US)

(73) Assignee: Nite Ize, Inc., Boulder, CO (US)

( * ) Notice: Subject to any disclaimer, the term of this patent is extended or adjusted under 35 U.S.C. 154(b) by 73 days.

(21) Appl. No.: 14/587,769

(22) Filed: Dec. 31, 2014

(65) Prior Publication Data

US 2015/0190029 A1 Jul. 9, 2015

Related U.S. Application Data

(60) Provisional application No. 61/924,191, filed on Jan. 6, 2014.

(51) Int. Cl.

| | |
|---|---|
| ***A47L 13/16*** | (2006.01) |
| ***A47L 13/41*** | (2006.01) |
| ***A47L 13/11*** | (2006.01) |
| ***A47L 25/00*** | (2006.01) |

(52) U.S. Cl.

CPC ..... *A47L 13/16* (2013.01); *A47L 13/11* (2013.01); *A47L 25/00* (2013.01); *A47L 13/41* (2013.01)

(58) Field of Classification Search

CPC ..... A47L 13/16; A47L 13/40–13/41; B08B 1/006

USPC ..... 15/214, 208–210.1

See application file for complete search history.

(56) References Cited

U.S. PATENT DOCUMENTS

| | | | | |
|---|---|---|---|---|
| 5,900,068 | A | 5/1999 | Thomas | |
| 7,310,847 | B2 * | 12/2007 | Bolkan | A47L 17/08 15/104.94 |
| D577,574 | S * | 9/2008 | Liang | D8/356 |
| D729,476 | S | 5/2015 | Haarburger | |
| 2002/0000455 | A1 * | 1/2002 | Condliff | A45F 5/004 224/162 |
| 2011/0131742 | A1 * | 6/2011 | Cheung | A47L 23/10 15/210.1 |
| 2012/0066865 | A1 | 3/2012 | Lauder et al. | |
| 2013/0067671 | A1 | 3/2013 | Lee | |

FOREIGN PATENT DOCUMENTS

| | | | |
|---|---|---|---|
| DE | 20 2011 108 865 U1 * | 11/2012 | A47L 13/16 |
| JP | ZL201430021191.0 | 12/2014 | |

OTHER PUBLICATIONS

International Search Report in co-pending PCT Application No. PCT/US2015/010049.

Schroeder; "The Wonders of MicroFibre"; *Promotional Products by PromoDepot,* Mar. 13, 2013; retrieved from Internet on Mar. 9, 2015; <URL: http://promodepot-promotional-products.blogspot.com (pp. 1 and 2)>.

Steyn; "The iGlaze + Versa Cover for iPad review: robust and artful"; *Gearburn,* Oct. 10, 2012; retrieved from Internet on Mar. 9, 2015; <URL: http://gearburn.com/2012/10/the-iglaze-versacover-for-ipad-review-robust-and-artful>.

* cited by examiner

*Primary Examiner* — Laura C Guidotti

(74) *Attorney, Agent, or Firm* — Haynes and Boone, LLP

(57) ABSTRACT

A screen cleaning device including a soft cleaning material mounted on a back material including stiffeners. The stiffener has a first area and a second area, the first area for cleaning and the second area for holding. The second area may include an attachment mechanism that provides for attachment to a key chain or other holder.

16 Claims, 3 Drawing Sheets

SYSTEMS AND METHODS FOR A SCREEN CLEANER

CROSS-REFERENCE TO RELATED APPLICATIONS

This application claims the benefit of U.S. Provisional Patent Application No. 61/924,191 filed Jan. 6, 2014, and is incorporated by reference to the same extent as though fully contained herein.

BACKGROUND

Mobile devices, such as phones, tablets, and other devices in many cases include touch screens. As such, the user of the mobile device leaves fingerprints on the screen. In addition to fingerprints, other sources of dirt may leave the screen quite dirty and in need of cleaning. Users may not have a proper cleaning cloth available or the cleaning cloth may not be readily accessible.

DETAILED DESCRIPTION

Figure 1:
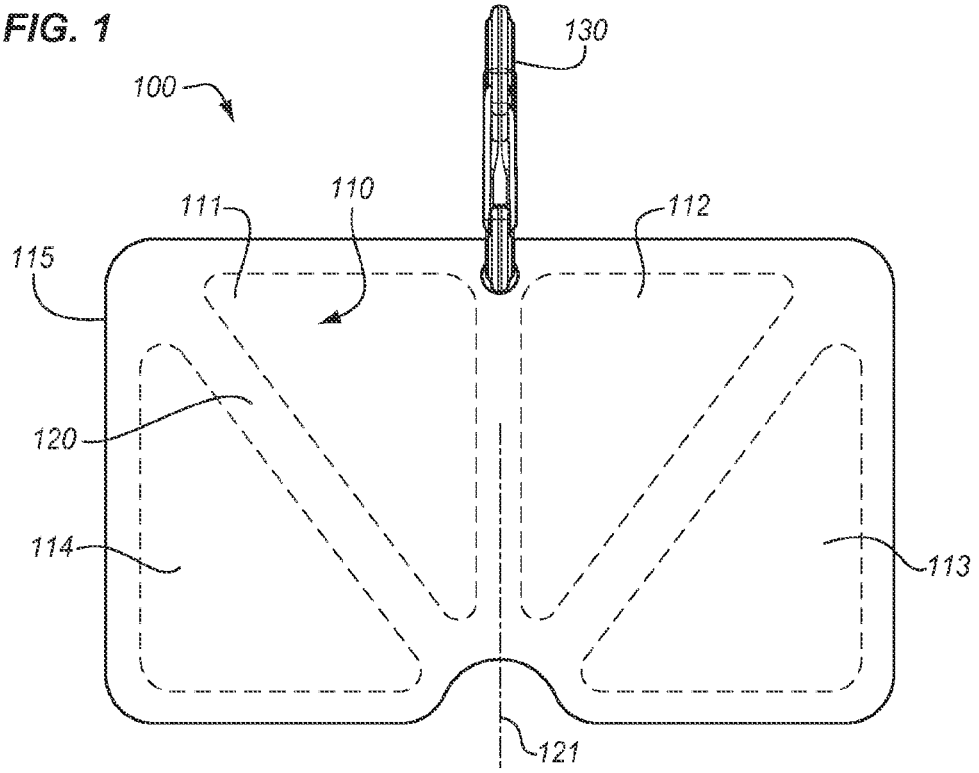
FIG. 1 shows a rear elevation view of one embodiment of a screen cleaning device.

Certain terminology is used herein for convenience only and is not to be taken as a limitation on the embodiments of a screen cleaning device. In the drawings, the same reference letters are employed for designating the same elements throughout the several figures.

The words "right," "left," "front," and "back" designate directions in the drawings to which reference is made. The words "inwardly" and "outwardly" refer to directions toward and away from, respectively, the geometric center of the case with flexible body portion and designated parts thereof. The terminology includes the words above specifically mentioned, derivatives thereof, and words of similar import. The proportions of the drawings are reflective of the electronic devices that they are designed to fit, and the drawings generally reflect scaled up or scaled down proportional representations of these cases.

Like reference numerals designate like or corresponding parts throughout the various views and with particular reference as delineated below.

Embodiments of a screen cleaning device generally include a soft cleaning material mounted on a back material including stiffeners. The stiffener has a first area and a second area, the first area for cleaning and the second area for holding. The second area may include an attachment mechanism that provides for attachment to a key chain or other holder.

FIG. 1 shows an embodiment of a screen cleaning device 100. Screen cleaning device 100 includes a back material 110. Many materials are possible for back material 110, but these materials will generally be those providing a pleasant feel to the user. An example of such a material is polyurethane, but numerous other possibilities exist. Back material 110 is generally rectangular shaped in some embodiments. Back material 110 is fitted with stiffening panels 111-114. These stiffening panels 111-114 provide shape and stiffness to back material 110. The stiffening panels are not actually visible in this view and, instead, are located behind back material 110 (stiffening panels are visible in FIG. 3). Stiffening panels 111-114 may in many cases be plastic, cardboard, or other similarly stiff material. The stiffening panels 111-114 are triangularly shaped in the embodiment shown in FIG. 1, but other configurations are possible. The stiffening panels 111-114 define an outer edge 115 and a bendable area 120 in the back material 110. Screen cleaning device 100 may also include an attachment device 130 in aperture 131. In this case, attachment device 130 is a double gated carabiner; however, numerous possibilities exist for such an attachment device, including key rings, strings, and other clips.

Figure 2:
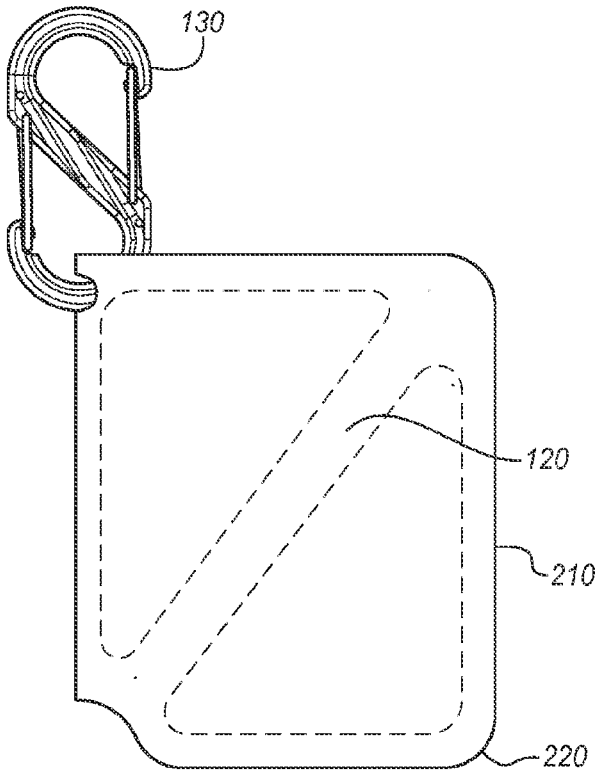
FIG. 2 shows a side view folded of the screen cleaning device of FIG. 1.

FIG. 2 shows another view of the screen cleaning device 100. Here, screen cleaning device 100 is shown in a folded configuration where opposing sides are folded together at seam 210 along seam 121. This is a carrying configuration where the device is not in use. By moving corners 220 apart and folding the device along seam 120, a cleaning configuration can be achieved as shown in FIG. 4.

Figure 3:
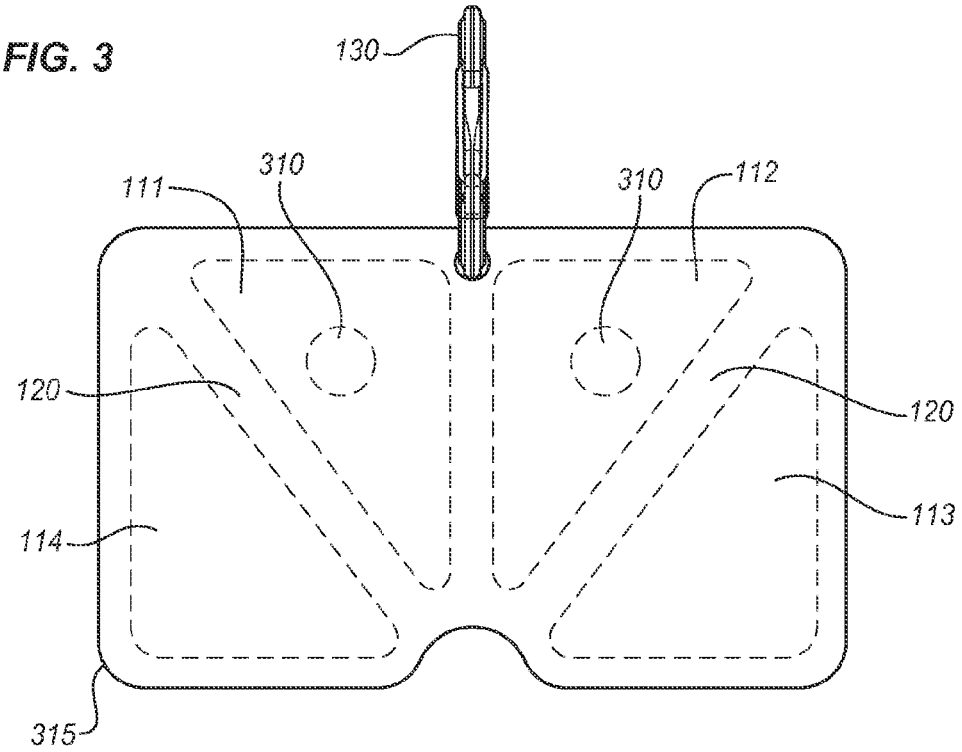
FIG. 3 shows a front elevation view of the screen cleaning device of FIG. 1.

FIG. 3 shows a front elevation view of the screen cleaning device of FIG. 1 without the cleaning material removed. The cleaning material may be suede, microfiber, or other type of screen cleaning material, which will be apparent to those skilled in the art in light of this disclosure. In this view, magnets 310 are visible. These magnets 310 hold the cleaning device 100 in a releasable cleaning configuration. The construction of the screen cleaning device 100 may be accomplished by creating a cut out for magnets 310 in stiffening panels 111, 112, respectively. Magnets 310 (or pieces of magnetic material) then may be fitted into stiffening panels 111, 112. All four stiffening panels 111-114 then may be placed or glued onto back material 110. Cleaning material (seen as cleaning material 410 in FIG. 4) then may be placed over the stiffening panels 111-114 and glued in place at border 315 and along bendable area 120 and seam 121. Various construction possibilities will be apparent to those of ordinary skill in the art. Additionally, magnets 310 need not both be magnets and, alternatively, one piece may be a magnet and the other piece a magnetically attractable material.

Figure 4:
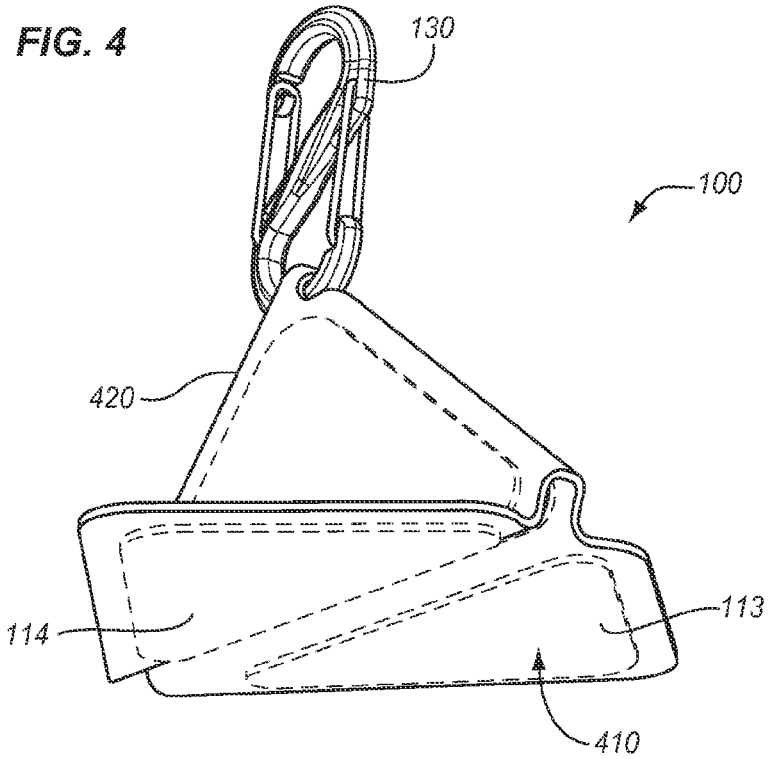
FIG. 4 shows a perspective view of the screen cleaning device of FIG. 1 in cleaning configuration.

FIG. 4 shows the screen cleaning device 100 configured in a cleaning configuration and shows cleaning material 410. Top portion 420 may be gripped easily by the user, and the cleaning device 100 may be navigated about the screen or other area in need of cleaning.

Alternative embodiments contemplated are differently shaped cleaning devices, including circular, triangular, and any other shape irregular and regular. Alternatively, magnetic material 310 may be eliminated and the stiffening panels 111, 112 may be affixed together by other means. This may include providing a Velcro or snap material. This may additionally include permanently affixing the materials together using glue or other material.

In many embodiments, cleaning devices include a single piece of backing material (back material 110 is exemplary) of any shape. A set of panels (stiffening panels 111-114 are exemplary) are affixed to the back material to provide a rigid shape for the cleaning device. A cleaning material (cleaning material 410 is exemplary) is affixed to one side of the back material enclosing the panels inside. A holder is configured to hold two of the panels together, providing for a holding surface for the user to hold the device. The holder may be magnets or other releasable and unreleasable holders as described above. The remaining panels provide for a relatively flat surface that may be run along a surface to clean the surface.

Figure 5:
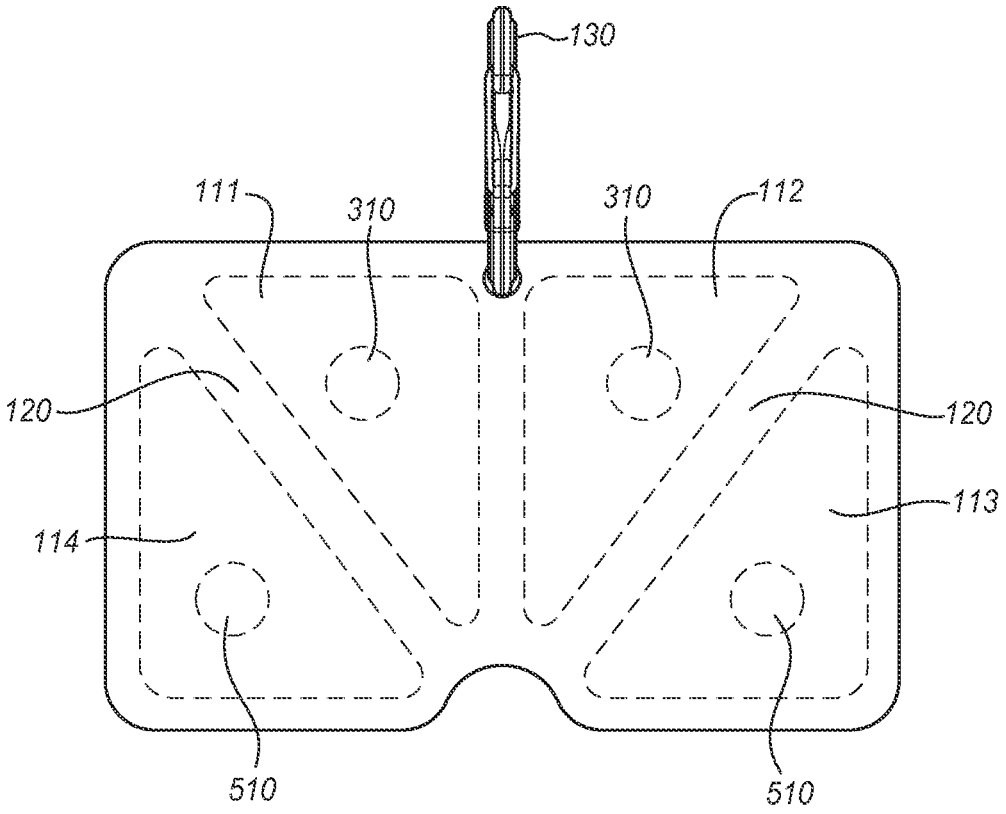
FIG. 5 shows a front elevation view of another embodiment of a screen cleaning device.

Shown in FIG. 5 is an alternative embodiment. In an alternative embodiment, additional magnets 510 may be included in stiffening panels 113, 114. In this embodiment, these additional magnets may hold stiffening panels 113, 114 together when the cleaning device 100 is not in use. The user may easily separate the magnets 510 and provide for the cleaning configuration.

In one embodiment, a cleaning device includes a back material and first, second, third, and fourth stiffeners, the first, second, third, and fourth stiffeners attached to a first side of the back material. The cleaning device further includes a cleaning material covering the first, second, third, and fourth stiffeners and the first side of the back material. Optionally, the cleaning device further includes a first piece and a second piece of magnetic material oriented in the first and second stiffeners, respectively, such that the cleaning device has a cleaning configuration where the back material is bent and the first and second stiffeners are held in proximity to each other by the first and second pieces of magnetic material. Alternatively, the back material is a planar sheet of material, and the first side of the back material is approximately planar. Optionally, the first, second, third, and fourth stiffeners are each approximately triangularly shaped. In one configuration, the back material is approximately rectangularly shaped. In another configuration, the first, second, third, and fourth stiffeners are arranged in a complementary arrangement where a hypotenuse of the first and fourth stiffeners are proximate, and the first and fourth stiffeners form approximately a rectangular shape on a first half of the back material; and a hypotenuse of the second and third stiffeners are proximate, and the second and third stiffeners form approximately a rectangular shape on a second half of the back material. Alternatively, when the first and second stiffeners are held in proximity to each other, the third and fourth stiffeners are folded approximately perpendicularly to the first and second stiffeners, the third and fourth stiffeners forming an approximately flat cleaning surface. In one configuration, the cleaning device further includes an attachment mechanism for attaching the cleaning device to a key chain. Optionally, the attachment mechanism is a double-gated carabiner. In one alternative, the cleaning device includes a first piece and a second piece of magnetic material oriented in the first and second stiffeners, respectively, such that the cleaning device has a cleaning configuration where the back material is bent and the first and second stiffeners are held in proximity to each other by the first and second pieces of magnetic material. The cleaning device further is configured where the back material is a planar sheet of material and the first side of the back material is approximately planar and wherein the first, second, third, and fourth stiffeners are each approximately triangularly shaped and the back material is approximately rectangularly shaped. The cleaning device is further configured such that the first, second, third, and fourth stiffeners are arranged in a complementary arrangement where a side of the first and fourth stiffeners are proximate, and the first and fourth stiffeners are on a first half of the back material; and a side of the second and third stiffeners are proximate, and the second and third stiffeners are on a second half of the back material. The cleaning device further is configured such that, when the first and second stiffeners are held in proximity to each other, the third and fourth stiffeners are folded approximately perpendicularly to the first and second stiffeners, the third and fourth stiffeners forming an approximately flat cleaning surface. In another configuration, the cleaning device further includes a first piece and a second piece of magnetic material oriented in the first and second stiffeners, respectively, such that the cleaning device has a cleaning configuration where the back material is bent and the first and second stiffeners are held in proximity to each other by the first and second pieces of magnetic material. The cleaning device is further configured such that the back material is a planar sheet of material, and the first side of the back material is approximately planar. The cleaning device further is configured such that the first, second, third, and fourth stiffeners each have a straight edge; and wherein the first, second, third, and fourth stiffeners are arranged in a complementary arrangement where the straight edge of the first and fourth stiffeners are proximate, and the first and fourth stiffeners are on a first half of the back material; and the straight edge of the second and third stiffeners are proximate, and the second and third stiffeners are on a second half of the back material; and wherein when the first and second stiffeners are held in proximity to each other, the third and fourth stiffeners are folded approximately perpendicularly to the first and second stiffeners, the third and fourth stiffeners forming an approximately flat cleaning surface. Optionally, the cleaning device further includes a third piece and a fourth piece of magnetic material in the third and fourth stiffeners, respectively, the third and fourth pieces of magnetic material holding the third and fourth stiffeners proximate and in a non-cleaning position such that the cleaning material is internal to a folded configuration of the back material; and the third and fourth pieces of magnetic material are releasable forming the cleaning configuration. Alternatively, the cleaning device further includes a first fastener and a second fastener oriented proximate to the first and second stiffeners, respectively, such that the cleaning device has a cleaning configuration where the back material is bent and the first and second stiffeners are held in proximity to each other by the first and second fasteners. Optionally, the cleaning device further includes a fastener oriented proximate to the first and second stiffeners, respectively, such that the cleaning device is bent into a cleaning configuration where the first and second stiffeners are held in proximity to each other by a fastener.

In another embodiment, a cleaning device includes a back material and first, second, third, and fourth stiffeners, the first, second, third, and fourth stiffeners attached to a first side of the back material. The cleaning device further includes a cleaning material covering the first, second, third, and fourth stiffeners and the first side of the back material. The cleaning device further includes a first piece and a second piece of magnetic material oriented in the first and second stiffeners, respectively, such that the cleaning device has a cleaning configuration where the back material is bent and the first and second stiffeners are held in proximity to each other by the first and second pieces of magnetic material. The cleaning device further is configured such that the back material is a planar sheet of material and the first side of the back material is approximately planar. The cleaning device further is configured such that the first, second, third, and fourth stiffeners each have a straight edge. The cleaning device further is configured such that the first, second, third, and fourth stiffeners are arranged in a complementary arrangement where the straight edge of the first and fourth stiffeners are proximate, and the first and fourth stiffeners are on a first half of the back material; and the straight edge of the second and third stiffeners are proximate, and the second and third stiffeners are on a second half of the back material. The cleaning device further is configured such that, when the first and second stiffeners are held in proximity to each other, the third and fourth stiffeners are folded approximately perpendicularly to the first and second stiffeners, the third and fourth stiffeners forming an approximately flat cleaning surface.

In another embodiment, a cleaning device includes a back material and first, second, third, and fourth stiffeners, the first, second, third, and fourth stiffeners attached to a first side of the back material. The cleaning device further includes a cleaning material covering the first, second, third, and fourth stiffeners and the first side of the back material. The cleaning device further includes a fastener system oriented proximate to the first and second stiffeners, such that the cleaning device has a cleaning configuration where the back material is bent and the first and second stiffeners are held in proximity to each other by the fastener system. The cleaning device further is configured such that wherein the back material is a planar sheet of material, and the first side of the back material is approximately planar. The cleaning device further is configured such that the first, second, third, and fourth stiffeners each have a straight edge. The cleaning device further is configured such that the first, second, third, and fourth stiffeners are arranged in a complementary arrangement where the straight edge of the first and fourth stiffeners are proximate, and the first and fourth stiffeners are on a first half of the back material; and the straight edge of the second and third stiffeners are proximate, and the second and third stiffeners are on a second half of the back material. The cleaning device further is configured such that, when the first and second stiffeners are held in proximity to each other, the third and fourth stiffeners are folded approximately perpendicularly to the first and second stiffeners, the third and fourth stiffeners forming an approximately flat cleaning surface. Optionally, the fastener system is a first magnet and a second magnet oriented in the first and second stiffeners, respectively. Alternatively, the first, second, third, and fourth stiffeners are approximately triangular. Optionally, the back material is polyurethane. In one configuration, the cleaning device further includes an attachment mechanism for attaching the cleaning device to a key chain, wherein the attachment mechanism is a double-gated carabiner.

While specific embodiments have been described in detail in the foregoing detailed description and illustrated in the accompanying drawings, it will be appreciated by those skilled in the art that various modifications and alternatives to those details could be developed in light of the overall teachings of the disclosure and the broad inventive concepts thereof. It is understood, therefore, that the scope of this disclosure is not limited to the particular examples and implementations disclosed herein, but is intended to cover modifications within the spirit and scope thereof as defined by the appended claims and any and all equivalents thereof. Note that, although particular embodiments are shown, features of each attachment may be interchanged between embodiments. The previous detailed description is of a small number of embodiments for implementing the systems and methods for a cleaning device and is not intended to be limiting in scope. The following claims set forth a number of the embodiments of the systems and methods for a cleaning device disclosed with greater particularity.

The invention claimed is:

1. A cleaning device comprising:

a back material;

first, second, third, and fourth stiffeners, the first, second, third, and fourth stiffeners attached to a first side of the back material;

a cleaning material covering the first, second, third, and fourth stiffeners and the first side of the back material; and a first piece and a second piece of magnetic material oriented in the first and second stiffeners, respectively, such that the cleaning device has a cleaning configuration where the back material is bent and the first and second stiffeners are held in proximity to each other by the first and second pieces of magnetic material, wherein the back material is a planar sheet of material and the first side of the back material is approximately planar and the first, second, third, and fourth stiffeners are each approximately triangularly shaped.

2. The cleaning device of claim 1 wherein the back material is approximately rectangularly shaped.

3. The cleaning device of claim 2 wherein the first, second, third, and fourth stiffeners are arranged in a complementary arrangement where a hypotenuse of the first and fourth stiffeners are proximate, and the first and fourth stiffeners form approximately a rectangular shape on a first half of the back material; and a hypotenuse of the second and third stiffeners are proximate, and the second and third stiffeners form approximately a rectangular shape on a second half of the back material.

4. The cleaning device of claim 3 wherein when the first and second stiffeners are held in proximity to each other, the third and fourth stiffeners are folded approximately perpendicularly to the first and second stiffeners, the third and fourth stiffeners forming an approximately flat cleaning surface.

5. The cleaning device of claim 4, further comprising a third piece and a fourth piece of magnetic material in the third and fourth stiffeners, respectively, the third and fourth pieces of magnetic material holding the third and fourth stiffeners proximate and in a non-cleaning position such that the cleaning material is internal to a folded configuration of the back material, and the third and fourth pieces of magnetic material are releasable forming the cleaning configuration.

6. The cleaning device of claim 1, further comprising an attachment mechanism for attaching the cleaning device to a key chain.

7. The cleaning device of claim 6 wherein the attachment mechanism is a double-gated carabiner.

8. The cleaning device of claim 1, further comprising a first fastener and a second fastener oriented proximate to the first and second stiffeners, respectively, such that the cleaning device has a cleaning configuration where the back material is bent and the first and second stiffeners are held in proximity to each other by the first and second fasteners.

9. The cleaning device of claim 1, further comprising a fastener oriented proximate to the first and second stiffeners, respectively, such that the cleaning device is bent into a cleaning configuration where the first and second stiffeners are held in proximity to each other by a fastener.

10. A cleaning device comprising:

a back material;

first, second, third, and fourth stiffeners, the first, second, third, and fourth stiffeners attached to a first side of the back material;

a cleaning material covering the first, second, third, and fourth stiffeners and the first side of the back material; and a first piece and a second piece of magnetic material oriented in the first and second stiffeners, respectively, such that the cleaning device has a cleaning configuration where the back material is bent and the first and second stiffeners are held in proximity to each other by the first and second pieces of magnetic material; and wherein the back material is a planar sheet of material, and the first side of the back material is approximately planar and wherein the first, second, third, and fourth stiffeners are each approximately triangularly shaped, and the back material is approximately rectangularly shaped; and wherein the first, second, third, and fourth stiffeners are arranged in a complementary arrangement where a side of the first and fourth stiffeners are proximate, and the first and fourth stiffeners are on a first half of the back material, and a side of the second and third stiffeners are proximate, and the second and third stiffeners are on a second half of the back material; and wherein when the first and second stiffeners are held in proximity to each other, the third and fourth stiffeners are folded approximately perpendicularly to the first and second stiffeners, the third and fourth stiffeners forming an approximately flat cleaning surface.

11. A cleaning device comprising:

a back material;

first, second, third, and fourth stiffeners, the first, second, third, and fourth stiffeners attached to a first side of the back material;

a cleaning material covering the first, second, third, and fourth stiffeners and the first side of the back material; and a first piece and a second piece of magnetic material oriented in the first and second stiffeners, respectively, such that the cleaning device has a cleaning configuration where the back material is bent and the first and second stiffeners are held in proximity to each other by the first and second pieces of magnetic material; and wherein the back material is a planar sheet of material, and the first side of the back material is approximately planar and wherein the first, second, third, and fourth stiffeners each have a straight edge, and wherein the first, second, third, and fourth stiffeners are arranged in a complementary arrangement where the straight edge of the first and fourth stiffeners are proximate and the first and fourth stiffeners on a first half of the back material; and the straight edge of the second and third stiffeners are proximate, and the second and third stiffeners are on a second half of the back material, and wherein when the first and second stiffeners are held in proximity to each other, the third and fourth stiffeners are folded approximately perpendicularly to the first and second stiffeners, the third and fourth stiffeners forming an approximately flat cleaning surface.

12. A cleaning device comprising:

a back material;

first, second, third, and fourth stiffeners, the first, second, third, and fourth stiffeners attached to a first side of the back material;

a cleaning material covering the first, second, third, and fourth stiffeners and the first side of the back material; and a first piece and a second piece of magnetic material oriented in the first and second stiffeners, respectively, such that the cleaning device has a cleaning configuration where the back material is bent and the first and second stiffeners are held in proximity to each other by the first and second pieces of magnetic material; and wherein the back material is a planar sheet of material, and the first side of the back material is approximately planar and wherein the first, second, third, and fourth stiffeners each have a straight edge; and wherein the first, second, third, and fourth stiffeners are arranged in a complementary arrangement where the straight edge of the first and fourth stiffeners are proximate, and the first and fourth stiffeners are on a first half of the back material; and the straight edge of the second and third stiffeners are proximate, and the second and third stiffeners are on a second half of the back material; and wherein when the first and second stiffeners are held in proximity to each other, the third and fourth stiffeners are folded approximately perpendicularly to the first and second stiffeners, the third and fourth stiffeners forming an approximately flat cleaning surface.

13. A cleaning device comprising:

a back material;

first, second, third, and fourth stiffeners, the first, second, third, and fourth stiffeners attached to a first side of the back material;

a cleaning material covering the first, second, third, and fourth stiffeners and the first side of the back material; and a fastener system oriented proximate to the first and second stiffeners, such that the cleaning device has a cleaning configuration where the back material is bent and the first and second stiffeners are held in proximity to each other by the fastener system; and wherein the back material is a planar sheet of material, and the first side of the back material is approximately planar and wherein the first, second, third, and fourth stiffeners each have a straight edge, and wherein the first, second, third, and fourth stiffeners are arranged in a complementary arrangement where the straight edge of the first and fourth stiffeners are proximate, and the first and fourth stiffeners are on a first half of the back material; and the straight edge of the second and third stiffeners are proximate, and the second and third stiffeners are on a second half of the back material; and wherein when the first and second stiffeners are held in proximity to each other, the third and fourth stiffeners are folded approximately perpendicularly to the first and second stiffeners, the third and fourth stiffeners forming an approximately flat cleaning surface; wherein the fastener system is a first magnet and a second magnet oriented in the first and second stiffeners, respectively.

14. The cleaning device of claim 13, further comprising an attachment mechanism for attaching the cleaning device to a key chain wherein the attachment mechanism is a double-gated carabiner.

15. A cleaning device comprising:

a back material;

first, second, third, and fourth stiffeners, the first, second, third, and fourth stiffeners attached to a first side of the back material;

a cleaning material covering the first, second, third, and fourth stiffeners and the first side of the back material; and a fastener system oriented proximate to the first and second stiffeners, such that the cleaning device has a cleaning configuration where the back material is bent and the first and second stiffeners are held in proximity to each other by the fastener system; and wherein the back material is a planar sheet of material, and the first side of the back material is approximately planar and wherein the first, second, third, and fourth stiffeners each have a straight edge, and wherein the first, second, third, and fourth stiffeners are arranged in a complementary arrangement where the straight edge of the first and fourth stiffeners are proximate, and the first and fourth stiffeners are on a first half of the back material; and the straight edge of the second and third stiffeners are proximate, and the second and third stiffeners are on a second half of the back material; and wherein when the first and second stiffeners are held in proximity to each other, the third and fourth stiffeners are folded approximately perpendicularly to the first and second stiffeners, the third and fourth stiffeners forming an approximately flat cleaning surface; wherein the first, second, third, and fourth stiffeners are approximately triangular.

16. The cleaning device of claim 15 wherein the back material is polyurethane.

* * * * *